US011432667B2

(12) United States Patent
Chen

(10) Patent No.: US 11,432,667 B2
(45) Date of Patent: Sep. 6, 2022

(54) BEVERAGE CUP WITH BEVERAGE INGREDIENT CONTAINER AND STRAW CUP LID

(71) Applicant: PACK CHIC INTERNATIONAL CORPORATION, Mahé (SC)

(72) Inventor: Hung-Shiang Chen, New Taipei (TW)

( * ) Notice: Subject to any disclaimer, the term of this patent is extended or adjusted under 35 U.S.C. 154(b) by 0 days.

(21) Appl. No.: 17/123,112

(22) Filed: Dec. 16, 2020

(65) Prior Publication Data

US 2021/0219755 A1 Jul. 22, 2021

(30) Foreign Application Priority Data

Jan. 22, 2020 (TW) ..... 109102515
Jul. 28, 2020 (TW) ..... 109125449

(51) Int. Cl.
*A47G 19/22* (2006.01)
*B65D 43/02* (2006.01)
*B65D 47/12* (2006.01)

(52) U.S. Cl.
CPC ..... *A47G 19/2272* (2013.01); *B65D 43/0212* (2013.01); *B65D 47/128* (2013.01);
(Continued)

(58) Field of Classification Search
CPC ..... A47G 19/2272; B65D 43/0212; B65D 47/128; B65D 2543/00046;
(Continued)

(56) References Cited

U.S. PATENT DOCUMENTS 5,085,330 A * 2/1992 Paulin ..... A47G 19/2272 215/387
7,644,834 B2 * 1/2010 Castora ..... A61B 50/36 220/731

(Continued)

FOREIGN PATENT DOCUMENTS

EP 1840041 A1 * 10/2007 ..... B65D 81/3216
KR 20130100248 A * 9/2013

(Continued)

*Primary Examiner* — James N Smalley
*Assistant Examiner* — John Martin Hoppmann

(57) ABSTRACT

A beverage cup for containing a beverage includes a beverage ingredient container installed in the beverage cup for placing beverage ingredients, and a cup lid fastened to the mouth of the beverage cup. The beverage ingredient container has an upper cup and a lower cup concavely and downwardly formed for placing the beverage ingredients, and a beverage through hole formed at the bottom of the upper cup. The cup lid includes a cover, a straw protruded from the cover, and a straw cap connected to an edge of cup lid by a strip for covering the straw, so that the straw cap can cover a straw mouth to prevent beverage leakage and keep the straw mouth clean. When drinking, the beverage enters into the beverage ingredient container through the beverage through hole and flows together with the beverage ingredient towards the straw to achieve the effect of drinking the beverage together with the beverage ingredients. Since the beverage cup reduces the use of straws, plastic films, and waste that is uneasy to recycle, this invention will make the environment healthier and cleaner.

10 Claims, 6 Drawing Sheets

(52) U.S. Cl.
CPC ..... *B65D 2543/00046* (2013.01); *B65D 2543/00092* (2013.01); *B65D 2543/00796* (2013.01)

(58) Field of Classification Search
CPC ..... B65D 2543/00092; B65D 2543/00796; B65D 55/16; B65D 81/3222; B65D 2543/00296; B65D 2543/00537; B65D 2543/00564; B65D 2543/0062; B65D 2543/00685; B65D 2543/00731; B65D 2543/00805; B65D 51/007; B65D 51/20; B65D 2251/0003; B65D 2251/0006; B65D 2251/0028; B65D 2517/0038; B65D 47/06; B65D 51/18; B65D 21/02; B65D 43/08; B65D 47/26; B65D 47/30; B65D 47/141
USPC ..... 206/217, 219, 0.5, 804, 222; 220/254.1, 220/505, 375, 506, 780, 23.87, 254.7
See application file for complete search history.

(56) References Cited

U.S. PATENT DOCUMENTS

| | | | | |
|---|---|---|---|---|
| 2003/0024930 | A1* | 2/2003 | Smith | B65D 43/0212 220/254.1 |
| 2009/0108003 | A1* | 4/2009 | Tripsianes | A47G 19/2288 220/521 |
| 2019/0084731 | A1* | 3/2019 | Chou | B65D 47/0842 |

FOREIGN PATENT DOCUMENTS

| | | | | |
|---|---|---|---|---|
| TW | M548138 | | 9/2017 | |
| TW | M570062 | | 11/2018 | |
| TW | M-593995 | * | 4/2020 | |
| TW | M601724 | | 9/2020 | |
| WO | WO-03106292 | A1 * | 12/2003 | B65D 81/3222 |
| WO | WO-2018194450 | A1 * | 10/2018 | B65D 85/816 |

* cited by examiner

BEVERAGE CUP WITH BEVERAGE INGREDIENT CONTAINER AND STRAW CUP LID

BACKGROUND OF THE INVENTION

Field of the Invention

The present invention relates to a beverage cup with a beverage ingredient container and a straw cup lid, in particular to the beverage cup having a cup, a beverage ingredient container, and a cup lid disposed at different levels of the beverage cup for containing beverage, and beverage ingredients, and providing a straw and a straw lid respectively, so that a user/consumer can drink the beverage and suck up the beverage ingredients at the same time from the straw at the cup lid of the beverage cup.

Description of Related Art

Plastic straw is one of the commonly used utensils for people to drink beverage, but its practical application still has the following drawbacks: (A) Disposable straws do not have a straw cover to protect the upper end of the straw, so that the straw mouth and beverage may be contaminated by bacteria, viruses and dust easily. (B) Straws with a slender tubular structure made of plastic have a very low recycling rate, and most of the used straws can only be treated as garbage which creates a heavy burden to garbage disposal and the environment. (C) Regardless of the material of the straw, it is necessary to make a sharp slant tip at the bottom end of the straw in order to poke the straw into a plastic film sealed onto the beverage cup, so that it may injury the users or consumers accidentally or hurt other creatures when the sharp straw is discarded outdoors.

In addition, the plastic film of the conventional beverage cup is made of a thin and lightweight material, so that it is easy for the users or consumers to discard the plastic film freely which makes the recycling process very difficult and causes drain blockage, and the plastic film may even be eaten by animals by mistake. Therefore, the plastic straw and the plastic film of the conventional beverage cup have caused pollutions to the environment, and the laws of many countries have banned the use of plastic straws. However, many other beverage ingredients such as tapioca ball, coffee jelly, pudding, etc. are added into the beverage in addition to the liquid of the beverage itself, and it will be very difficult for users/consumers to suck up the beverage ingredients in the beverage without using the conventional straw.

SUMMARY OF THE INVENTION

Therefore, it is a primary objective of the present invention to provide a beverage cup with a beverage ingredient container and a straw cup lid, characterized in that a beverage ingredient container installed in the beverage cup and a cup lid with a straw are provided for containing a beverage and a beverage ingredient in different levels of the beverage cup, so that the beverage cup allows users/consumers to drink the beverage and suck up the beverage ingredient without a conventional straw, so as to achieve the effects of allowing the users/consumers to drink the beverage and sucking up the beverage ingredient at the same time by a tilted suction, and avoiding the manufacture and use of straws, plastic films, and other waste.

A secondary objective of the present invention is to provide a beverage cup with a beverage ingredient container and a straw cup lid, and the cup lid is integrally formed with a straw cap, such that the straw cap can cover the top of the straw to prevent beverage leakage or contamination by dust or bacteria when the beverage cup is not in use for drinking, and the cup lid, the straw, and the straw cap can be recycled together after use, so as to achieve the purposes of recycling and environmental protection.

Another objective of the present invention is to provide a beverage cup with a beverage ingredient container and a straw cup lid, and a straw cap fixing portion is formed on the cup lid for temporarily engaging the straw cap with the straw cap fixing portion while users/consumers are drinking from the beverage cup, so as to achieve the effect of preventing the straw cap from shaking or hindering the users/consumers from drinking the beverage.

DESCRIPTION OF THE PREFERRED EMBODIMENTS

The aforementioned and other objects, characteristics and advantages of the present invention will become apparent with the detailed description of the preferred embodiments and the illustration of related drawings as follows.

Figure 1:
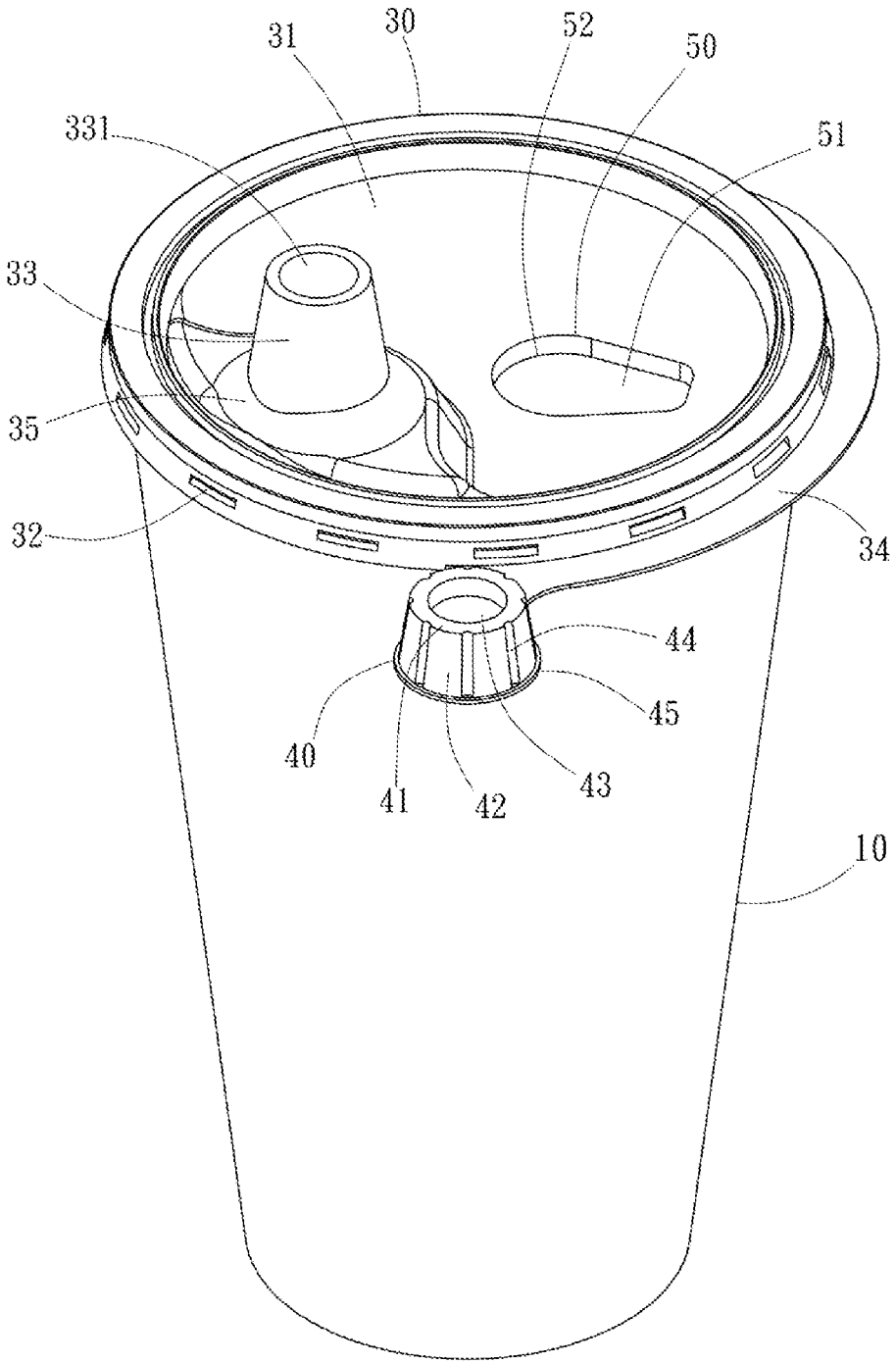
FIG. 1 is a perspective view of a beverage cup with a beverage ingredient container and a straw cup lid in accordance with a preferred embodiment of the present invention.
Figure 2:
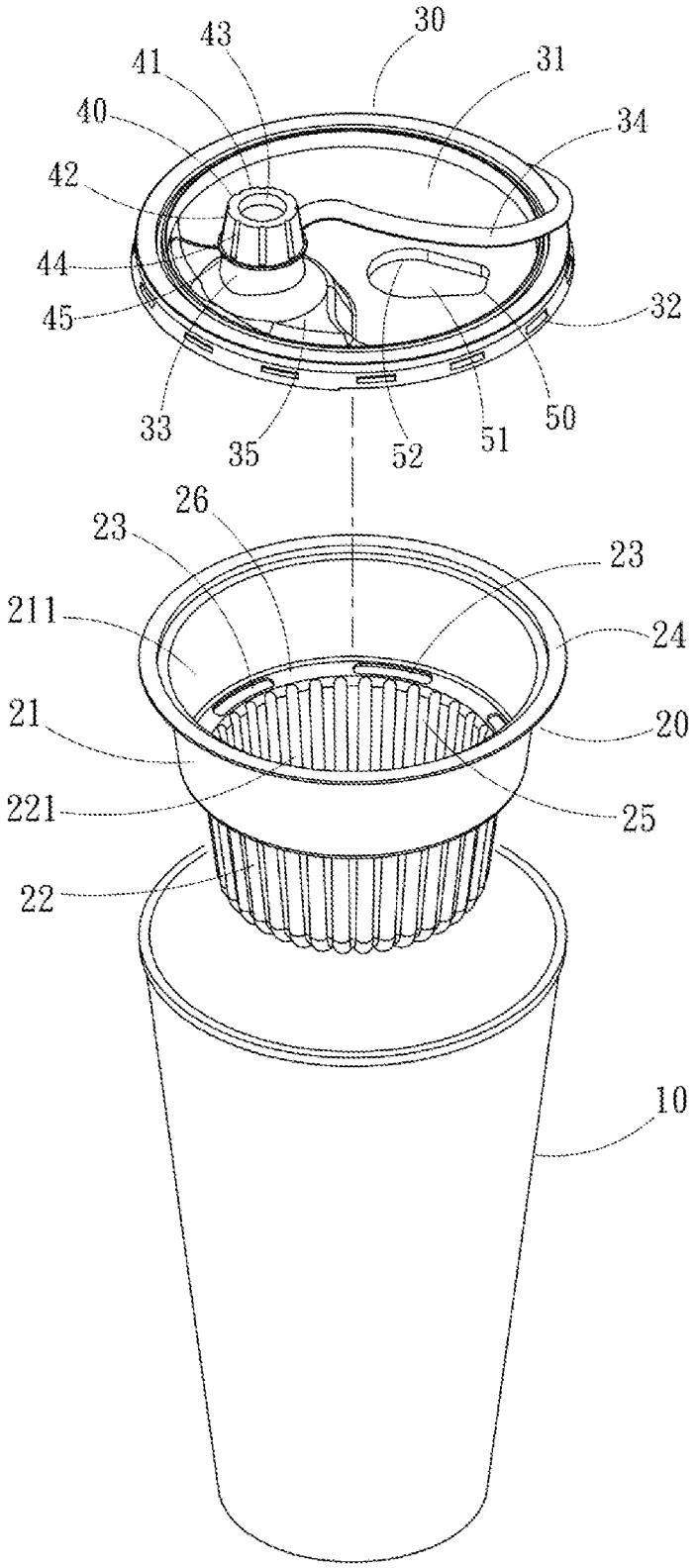
FIG. 2 is an exploded view of a beverage cup with a beverage ingredient container and a straw cup lid in accordance with a preferred embodiment of the present invention.
Figure 3:
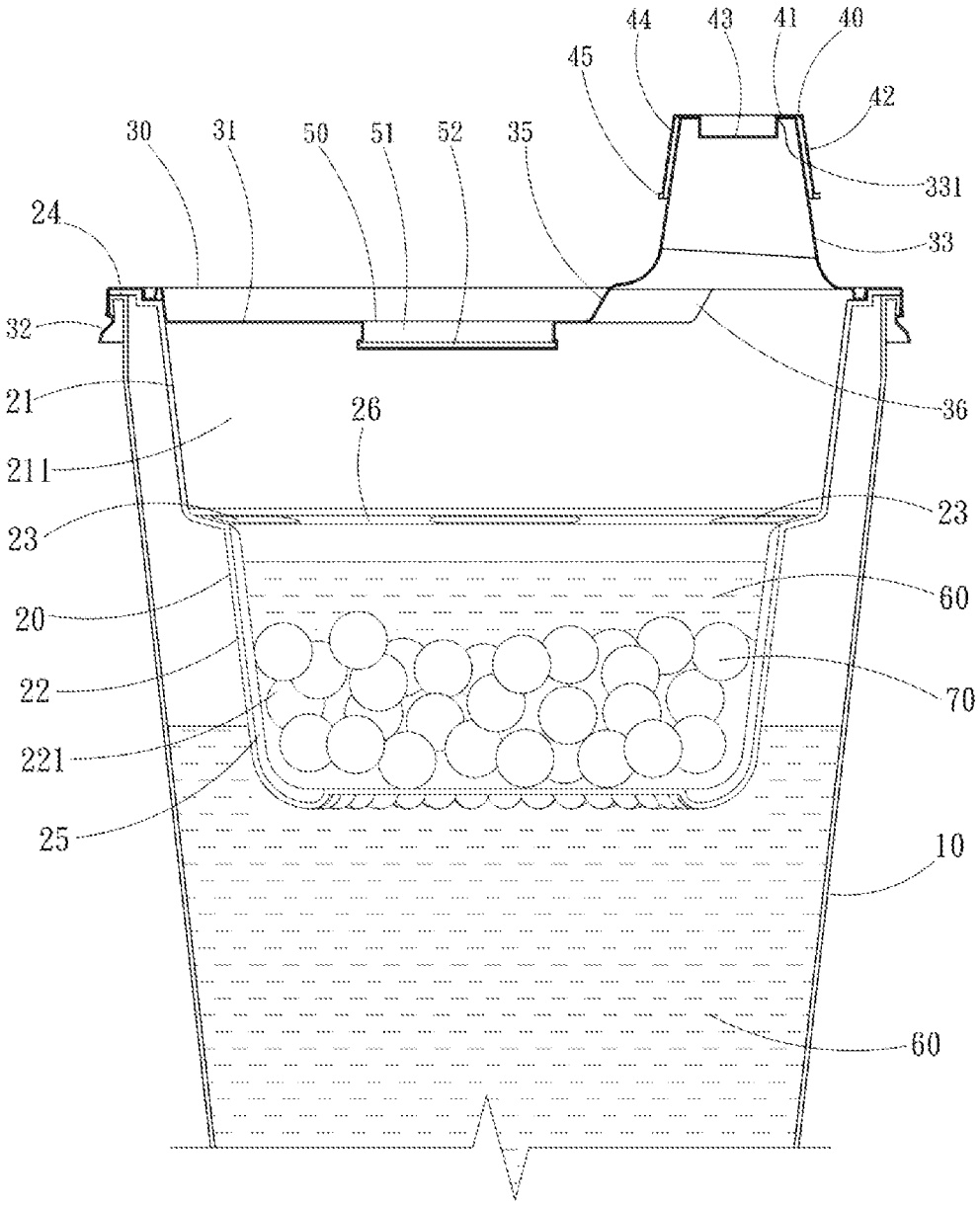
FIG. 3 is a schematic view of a beverage cup and a beverage ingredient container for containing a beverage and beverage ingredients at different levels in accordance with the present invention.

With reference to FIGS. 1 to 3 for a beverage cup 10 with a beverage ingredient container in accordance with a preferred embodiment of the present invention, the beverage cup 10 comprises a beverage ingredient container 20 installed in the beverage cup 10, and a cup lid 30 fastened to the beverage cup 10.

Wherein, the beverage cup 10 is a conventional conical cup made of plastic or paper and used by beverage vendors for containing a beverage. In FIGS. 2 and 3, the beverage ingredient container 20 is a container installed into the beverage cup 10 and provided for containing beverage ingredients such as tapioca ball, coffee jelly, pudding, etc. and preferably an integrally formed container made of a food-grade recyclable plastic material or a biodegradable polylactide (PLA) material, and the beverage cup 10 comprises an upper cup 21 having an upper compartment 211 concavely formed under the upper cup 21, and a lower cup 22 having a lower compartment 221 concavely formed under the bottom of the lower cup 22, and the upper compartment 211 and the lower compartment 221 communicate with each other; the bottom of the upper cup 21 has a plurality of beverage through holes 23 communicating to the upper compartment 211 and the interior of the beverage cup 10, and a protruding rim 24 is formed at an outer side of a cup mouth of the upper cup 21 for abutting against a cup mouth of the beverage cup 10; and the lower cup 22 does not have any other through hole and is used for containing the beverage ingredients and beverage; wherein the beverage through hole 23 can be expanded into a plurality of through holes formed around a side of the upper cup 21.

In FIGS. 2 and 3, the cup lid 30 is preferably an integrally formed circular lid made of a food-grade recyclable plastic material or a biodegradable polylactide (PLA) material, and the cup lid 30 has a cover 31 for covering the beverage cup 10; a latch member 32, formed around the cover 31 and extended downward for latching a cup mouth at the upper end of the beverage cup 10; a straw 33, protruded from the cover 31, and having a suction hole 331 formed at the top of the straw 33 and communicating with the interior of the beverage cup 10 through the straw 33; a strip 34, formed by integrally cutting the remaining material of the cup lid 30 without additional manufacturing and assembling, so that the strip 34 has an end coupled to the latch member 32 and the other end is integrally formed with a straw cap 40, and the straw cap 40 is detachably on the straw 33; and a straw cap fixing portion 50, formed on the cover 31, for detachably installing the straw cap 40 onto the straw cap fixing portion 50 after the straw cap 40 is separated from the straw 33.

Figure 4:
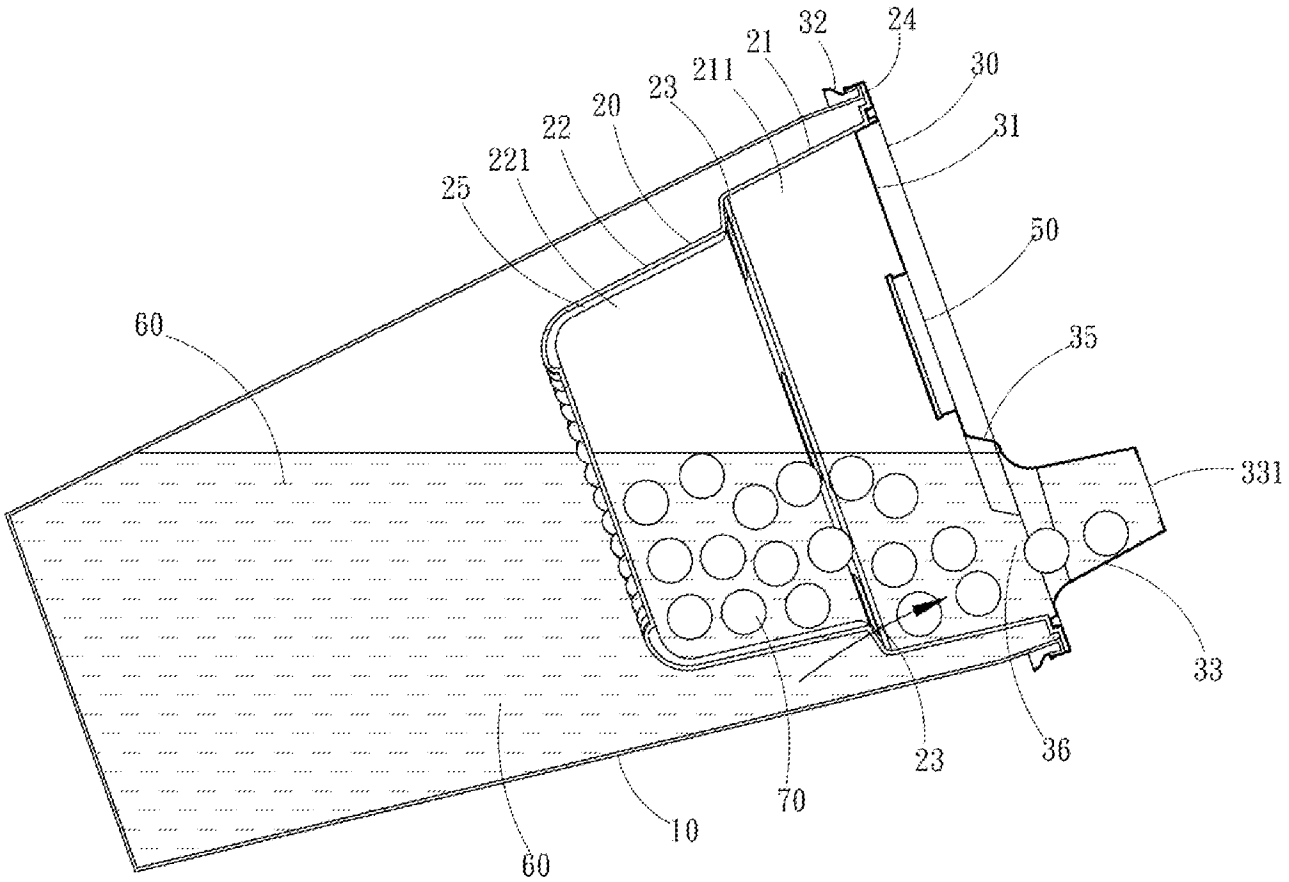
FIG. 4 is a schematic view of a beverage ingredient container and a straw on a straw cup lid of the present invention, which are provided for drinking a beverage and sucking up beverage ingredients respectively.

In FIGS. 3 and 4, when beverage cup of the present invention is used, a beverage 60 is put into the beverage cup 10, and the beverage ingredient container 20 is placed into the beverage cup 10. Now, the beverage 60 will flow into the lower compartment 221 through the beverage through hole 23 of the beverage ingredient container 20, and then a beverage ingredient 70 is put into the beverage ingredient container 20, so that the beverage ingredient 70 and a portion of the beverage 60 are collected in the lower compartment 221 of the lower cup 22, and then the cup lid 30 is covered onto the beverage cup 10, such that the cup lid 30 covers the beverage ingredient container 20, and the surrounding latch members 32 are snapped into the cup mouth at the upper end of the beverage cup 10. In FIG. 4, when a user/consumer drinks from the beverage cup, the user/consumer simply sucks from the straw 33 on the cup lid 30 by his/her mouth without the need of the conventional straw by a tilted suction, so that the beverage 60 contained in the beverage cup 10 will pass through the beverage through hole 23 of the beverage ingredient container 20 to the straw 33, while the beverage ingredient 70 contained in the beverage ingredient container 20 will mix with the beverage 60 and flow together to the straw 33. Since the straw is designed with a tapered mouth (whose diameter changes from a larger one to a smaller one) to expedite the flow of the beverage, so that that user/consumer can suck the beverage 60 and beverage ingredient 70 easily.

In FIGS. 2 and 3, the beverage ingredient container 20 has a plurality of protrusions 25 formed on a cup wall of the lower cup 22 and facing the inside and outside of the lower compartment 221, wherein the protrusions 25 are convex strips provided for minimizing the contact of the beverage ingredient 70 with the cup wall to prevent the beverage ingredient 70 from sticking on the cup wall. In addition, the plurality of protrusions 25 formed at the outer side of the lower cup 22 is further conducive to guide the beverage 60 contained in the beverage cup 10 to enter into the beverage ingredient container through the beverage through hole 23. In addition, the upper cup 21 and the lower cup 22 of the beverage ingredient container 20 are preferably designed to be a funnel-shaped container having an upper end with a diameter greater than that of a lower end, and the beverage through holes 23 are formed around a bottom 26 of the upper cup 21. In addition, the beverage through hole 23 can be expanded into a plurality of through holes formed around a side of the upper cup 21 to facilitate the process of mixing the beverage 60 with the beverage ingredient 70. The lower cup 22 does not have any other hole, so that when a user/consumer drinks the beverage to half of the cup (as shown in FIG. 3), a portion of beverage 60 remains in the lower compartment 221 of the lower cup 22 to keep the beverage ingredient 70 moist, so as to prevent the beverage ingredient 70 from sticking together.

In FIGS. 2 and 3, the straw cap 40 preferably has a straw cap ceiling 41, and a straw cap sidewall 42 surrounding around the straw cap ceiling 41 and extending downwardly. The middle of the straw cap ceiling 41 is recessed downwardly to form a plug 43. Therefore, the straw cap 40 can be detachably sheathed on the straw 33, and the straw cap ceiling 41 covers the top of the straw 33, and the straw cap sidewall 42 surrounds closely to a straw wall of the straw 33 to protect the beverage from being contaminated by bacteria, viruses, and dust, and the plug 43 is plugged into the suction hole 331 at the top of the straw 33 to prevent the beverage cup from spilling when the beverage cup is moved or toppled accidentally. In addition, the straw cap sidewall 42 further comprises an anti-slip part 44 which is comprised of a plurality of recessed grooves concavely formed on an inner side of the anti-slip part 44 or a plurality of convex strips, for wrapping around the straw 33 tightly, so that when the user/consumer pulls the straw cap 40 away from the suction hole 331 and moves the straw cap 40 to the straw cap fixing portion 50, the straw cap 40 will not slip easily.

Figure 5:
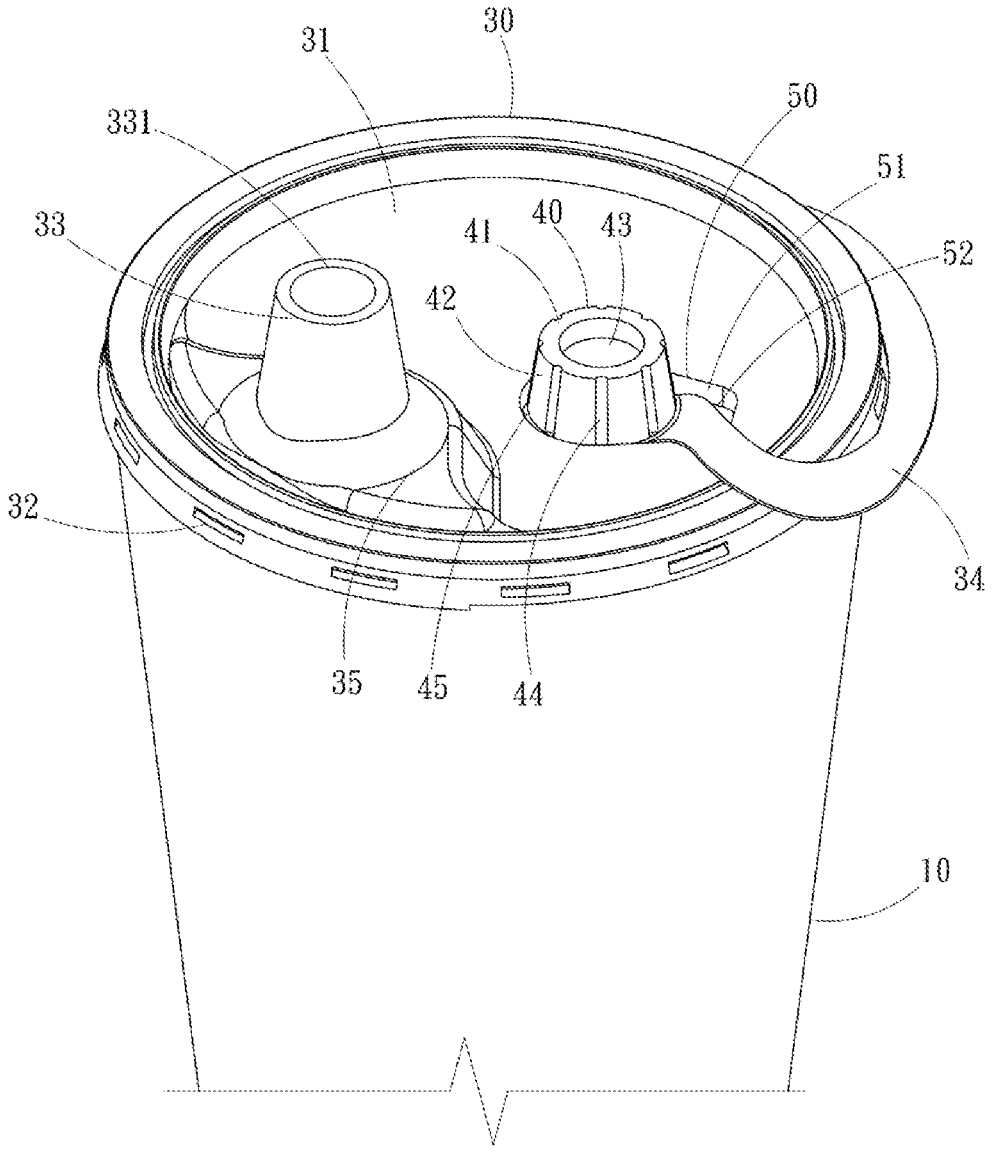
FIG. 5 is a schematic view showing a using status of a straw cup lid in accordance with a preferred embodiment of the present invention.
Figure 6:
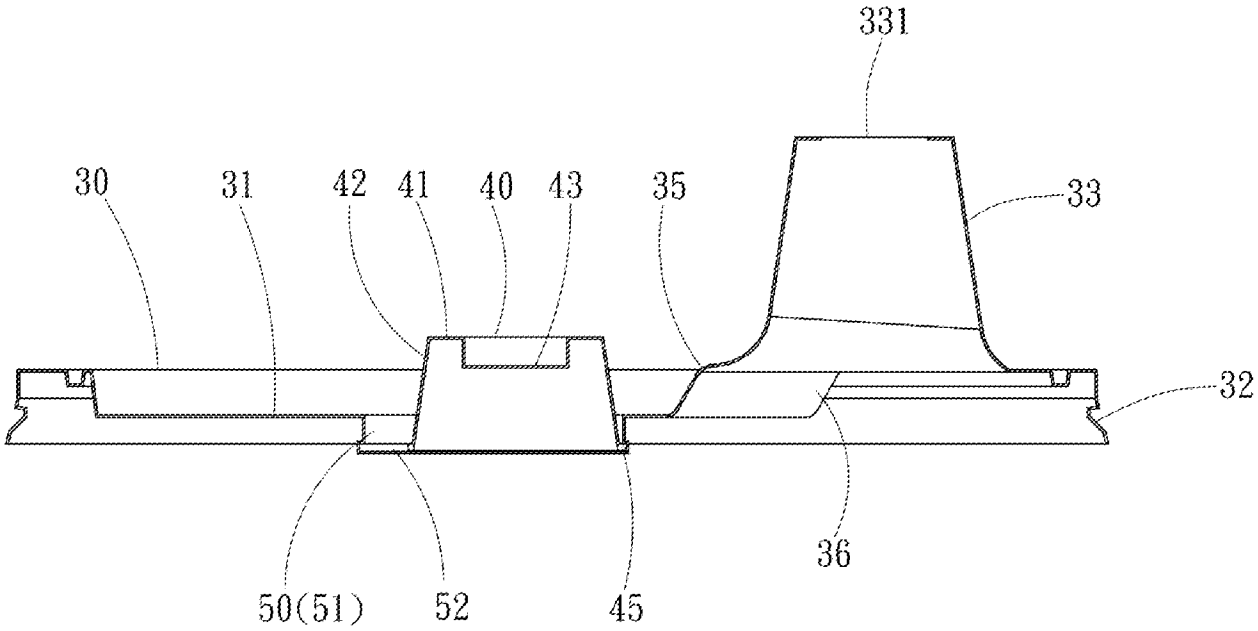
FIG. 6 is a cross-sectional view showing a using status of a straw cup lid in accordance with a preferred embodiment of the present invention.

In one of the preferred embodiments of the straw cap fixing portion 50 formed by the cover 31 of the cup lid 30 as shown in FIGS. 2, 5 and 6, the straw cap fixing portion 50 comprises a slot 51 concavely formed on the cover 31 and provided for detachably plugging the straw cap 40 into the slot 51, so that the straw cap 40 will be situated at a position away from the user/consumer's face while the user/consumer is drinking the beverage, and this arrangement avoids possible interference to the drinking of the beverage. Further, the periphery of the bottom of the slot 51 has a horizontally expanded latch groove 52, so that when the straw cap 40 is plugged into the slot 51, the straw cap 40 can be latched to the latch groove 52 to prevent the straw cap 40 from falling off easily. Specifically, a flange 45 is transversely protruded from a lower edge of the straw cap sidewall 42, and the flange 45 can be latched to the latch groove 52 when the straw cap 40 is plugged into the slot 51(as shown in FIG. 6) to make sure that the straw cap 40 does not fall off easily. When the user/consumer does not drink the beverage, the user/consumer can remove the straw cap 40 from the straw cap fixing portion 50 and cover the straw cap 40 onto the straw 33 (as shown in FIG. 3).

In FIGS. 2, 3 and 4, the cover 31 of the cup lid 30 is integrally formed with an upward protruding portion 35, and a diversion space 36 is defined on an inner side of the protruding portion 35 for accommodating the beverage, and the top of the protruding portion 35 is integrally formed with an upwardly extended and protruded straw 33, so that when the user/consumer drinks up, the structure of the diversion space 36 allows the beverage 60 and the beverage ingredient 70 to be collected more easily before flowing to the straw 33.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A beverage cup with a beverage ingredient container and a straw cup lid, for containing a beverage and a beverage ingredient at different levels of the beverage cup respectively, comprising:

a beverage cup, for containing the beverage;

a beverage ingredient container, being a container put into the beverage cup and used for placing the beverage ingredient, and having an upper cup with an upper compartment concavely formed thereunder, and a lower cup with a lower compartment concavely formed from a bottom of the upper cup, and the upper compartment and the lower compartment communicating with each other;

a plurality of beverage through holes formed at a non-concavely portion of the bottom of the upper cup, and communicating with the upper compartment and an interior of the beverage cup, and the lower cup does not have any other through hole; and a protruding rim disposed at the outer periphery of a cup mouth of the upper cup and abutting against the cup mouth of the beverage cup; and an upper cup lid, having a cover; a latch member, integrally formed around the cover and extended downward away from the cover; a straw, integrally formed and protruded out from the cover; a strip, with an end coupled to the latch member and the other end having a straw cap formed thereon, and the straw cap being detachably sheathed on the straw; and a straw cap fixing portion, formed on the cover, and provided for detachably installing the straw cap onto the straw cap fixing portion after the straw cap is separated from the straw.

2. The beverage cup with a beverage ingredient container and a straw cup lid as claimed in claim 1, wherein the lower cup has a plurality of protrusions formed around a cup wall of the lower cup, configured to be facing the interior of the lower compartment, for preventing the beverage ingredient from sticking to the cup wall.

3. The beverage cup with a beverage ingredient container and a straw cup lid as claimed in claim 2, wherein each of the plurality of protrusions is a convex strip.

4. The beverage cup with a beverage ingredient container and a straw cup lid as claimed in claim 3, wherein a plurality of other through holes are disposed around lateral sides of the upper cup.

5. The beverage cup with a beverage ingredient container and a straw cup lid as claimed in claim 4, wherein the beverage ingredient container is a funnel-shaped container.

6. The beverage cup with a beverage ingredient container and a straw cup lid as claimed in claim 1, wherein the straw cap fixing portion comprises a slot concavely and downwardly away from the cover formed on the cover, and the straw cap can be detachably installed into the slot.

7. The beverage cup with a beverage ingredient container and a straw cup lid as claimed in claim 6, wherein the slot has a horizontally relative to the cover expanded latch groove formed at the periphery of the bottom of the slot for latching the straw cap when the straw cap is plugged into the slot.

8. The beverage cup with a beverage ingredient container and a straw cup lid as claimed in claim 7, wherein the straw cap has a flange transversely protruded from a lower edge of the straw cap, and the flange is latched to the latch groove when the straw cap is plugged into the slot.

9. The beverage cup with a beverage ingredient container and a straw cup lid as claimed in claim 8, wherein the straw cap has a straw cap ceiling for covering a top of the straw with respect to the cover; a straw cap sidewall disposed around the periphery of the straw cap ceiling and extended downward away from the cover for closely surrounding a straw wall of the straw; and a plug concavely and downwardly away from the cover formed on the straw cap ceiling for plugging into the suction hole.

10. The beverage cup with a beverage ingredient container and a straw cup lid as claimed in claim 9, wherein the straw cap sidewall has an anti-slip part comprised of a plurality of recessed grooves concavely formed on an inner side of the straw cap sidewall or a plurality of convex strips.

* * * * *